US011598161B2

(12) United States Patent
Puskarskij et al.

(10) Patent No.: US 11,598,161 B2
(45) Date of Patent: Mar. 7, 2023

(54) OFFSHORE DRILLING RIG ASSEMBLY AND METHOD

(71) Applicant: MAERSK DRILLING A/S, Lyngby (DK)

(72) Inventors: Konstantin Puskarskij, Hellerup (DK); Kristian Hansen, Fredensborg (DK); Christian Schmidt, Odense (DK)

(73) Assignee: NOBLE DRILLING A/S, Kgs. Lyngby (DK)

( * ) Notice: Subject to any disclaimer, the term of this patent is extended or adjusted under 35 U.S.C. 154(b) by 24 days.

(21) Appl. No.: 16/962,978

(22) PCT Filed: Jan. 17, 2019

(86) PCT No.: PCT/DK2019/000020
§ 371 (c)(1),
(2) Date: Jul. 17, 2020

(87) PCT Pub. No.: WO2019/141322
PCT Pub. Date: Jul. 25, 2019

(65) Prior Publication Data

US 2021/0363837 A1 Nov. 25, 2021

(51) Int. Cl.
*E21B 19/00* (2006.01)

(52) U.S. Cl.
CPC ..... *E21B 19/006* (2013.01)

(58) Field of Classification Search
CPC ..... E21B 19/006
See application file for complete search history.

(56) References Cited

U.S. PATENT DOCUMENTS 4,712,620 A 12/1987 Lim et al.
6,041,865 A * 3/2000 Knapp ..... E21B 19/002 166/345

(Continued)

FOREIGN PATENT DOCUMENTS

EP 0088608 A2 * 9/1983 ..... E21B 7/128
GB 2 488 036 A 8/2012

(Continued)

OTHER PUBLICATIONS

International Patent Application No. PCT/DK2019/000020, International Search Report and Written Opinion dated May 14, 2019, 13 pgs.

*Primary Examiner* — Matthew R Buck
(74) *Attorney, Agent, or Firm* — Lathrop GPM LLP

(57) ABSTRACT

Well centre assembly for an offshore drilling rig and associated method. There is described a well centre assembly 10 for an offshore drilling rig. The well centre assembly 10 comprises a diverter assembly 16 and a movement control system 18. The movement control system 18 is operable between the diverter assembly 16 and a supporting structure 12 of the rig. In use, the movement control system 18 controls or permits relative movement between the diverter assembly 16 and the supporting structure 12. A connector such as a riser 34 connected to the diverter assembly 16 during deployment, while deployed or during retrieval of the riser 34 may experience external forces such as from tidal, wind and/or wave movement at a water surface 50, which may cause the positioning and/or orientation of the riser 34 to vary. The movement control system 18 may control the movement of the diverter assembly 16 so as to compensate for movement of the riser 34.

18 Claims, 6 Drawing Sheets

(56) References Cited

U.S. PATENT DOCUMENTS

| | | | | |
|---|---|---|---|---|
| 6,554,072 | B1 | 4/2003 | Mournian et al. | |
| 7,370,707 | B2 * | 5/2008 | McDaniel | E21B 19/004 166/380 |
| 8,474,538 | B2 * | 7/2013 | Wallace | E21B 19/006 166/350 |
| 9,422,789 | B2 * | 8/2016 | Bushman | E21B 34/04 |
| 9,458,681 | B2 * | 10/2016 | Wijning | E21B 19/10 |
| 2012/0070225 | A1 | 3/2012 | Wallace et al. | |
| 2016/0024879 | A1 | 1/2016 | Bushman et al. | |

FOREIGN PATENT DOCUMENTS

| | | | |
|---|---|---|---|
| WO | WO 2004/090279 | A1 | 10/2004 |
| WO | WO 2013/012317 | A1 | 1/2013 |

* cited by examiner

Section A–A

OFFSHORE DRILLING RIG ASSEMBLY AND METHOD

CROSS-REFERENCE TO RELATED APPLICATIONS

This application is a 35 U.S.C. § 371 filing of International Application No. PCT/DK2019/000020 filed Jan. 17, 2019, which claims the benefit of priority to Danish Patent Application No. PA 2018 00029 filed Jan. 17, 2018, each of which is incorporated herein by reference in its entirety.

FIELD

The present disclosure relates to controlling movement of a component of an offshore drilling rig.

BACKGROUND

An offshore drilling rig can be used for carrying out downhole operations such as downhole drilling operations. A downhole tool such as a drill can be deployed from an offshore drilling rig via a riser, which provides a connection between the offshore drilling rig and a wellhead located on a seabed, or the like. The riser can also receive drilling mud and other material from the wellhead and transfer the mud and other material to the surface for storage or processing.

The riser may be as short as several to several hundred metres for shallower waters and up to several thousand metres for deeper waters. In either case, the riser or the offshore drilling rig the riser is connected to can experience forces, such as caused by currents, tides, waves, wind, and the like, which can cause the riser to move or change orientation relative to the offshore drilling rig and/or the wellhead.

The connection between riser and the offshore drilling rig can be affected by the movement of the riser, which may result in loading, stress, and the like being placed on components such as the offshore drilling rig, the riser and/or the wellhead. Movement of the riser may therefore increase the likelihood of damage occurring to any of these components or to downhole tools deployed via these components. To reduce the likelihood of damage occurring, the riser may include a flexible component to permit flexing of at least part of the riser.

SUMMARY

An aspect or embodiment of the present disclosure relates to a well centre assembly for an offshore drilling rig, comprising: a diverter assembly; and a movement control system operable between the diverter assembly and a supporting structure of an offshore drilling rig. The movement control system may be configured to control movement of the diverter assembly.

In use, the diverter assembly may be moveable relative to a supporting structure of an offshore drilling rig. The movement control system may function to control movement of the diverter assembly relative to the supporting structure. The movement control system may permit, prevent, reduce, restrict, dampen, or otherwise control movement of the diverter assembly.

The diverter assembly may be mechanically associated with a component such as a riser. The diverter assembly may be connected to the component. The diverter assembly may be connected to, attached to, or otherwise mechanically associated with the component so that if the component moves, for example due to wind, water current, wave movement, tidal force, or the like, the diverter assembly may also move or be subject to loading, stress, or the like as a result of the movement of the component. Depending on the wind and/or water conditions, as well as the properties of the component such as buoyancy, flexibility, rigidity, or the like, the component may have a tendency to be displaced, move, move to a certain position, adopt a certain orientation, adopt a certain inclination, or the like.

In some examples, the component may be substantially static (e.g. the component may not move). However, the component may have been displaced from an equilibrium position or orientation (e.g. a position, orientation or inclination adopted by the component which may occur if there is no current, wind, waves, or the like) to a non-equilibrium position (e.g. a position, orientation or inclination adopted by the component which may occur if there is current, wind, waves, or the like present). For example, in a tidal area, or the like, there may be a steady or constant wind or water current in the same direction for at least some of the time. In some examples, the component may be displaced to a different position, orientation, inclination, or the like, and may maintain substantially the same position, orientation, inclination, or the like until or if there is a change in the water and/or wind conditions.

In some examples, the component may be moveable, for example, the component may be regularly or irregularly moved to or away from the equilibrium position. For example, if there are tidal forces, wave movement, current, wind, or the like present, the component may have a tendency to move, change position, change orientation, change inclination, or the like.

In some examples, if the component is being deployed, retrieved and/or otherwise moved (for example, during a hang-off scenario where the component is disconnected from another component such as the wellhead, or the like), there may be a change in the buoyancy or other property of the component. A change in the buoyancy or other property of the component may affect the positioning, movement, orientation, inclination, or the like of the component. If the component is being deployed, retrieved or otherwise moved, the change in the buoyancy or other property of the component may cause the component to move, change position, change orientation, change inclination, or the like.

In some examples, the movement control system may permit movement of the diverter assembly. In some examples, the diverter assembly may move in a manner corresponding to the position, orientation, inclination, or the like of the component. If the component is substantially static, the diverter assembly may similarly be substantially static. If the component moves, the diverter assembly may similarly move. The movement control system may control movement of the diverter assembly to minimise loading, stress or other damage-causing mechanism placed on the diverter assembly and/or the component, or any other associated components or structures of the offshore drilling rig and/or the wellhead, and/or to downhole tools deployed via these components.

In some examples, the movement control system may prevent movement of the diverter assembly. For example, the component may apply a force on the diverter assembly, which may not cause a corresponding movement on the diverter assembly if the movement control system prevents such a movement. In some examples, the movement control system may control movement of the diverter assembly in such a manner that the loading, stress, or other damage-causing mechanism may not be substantially minimised, which may occur if the diverter assembly is required to be in a certain position, orientation, inclination, or the like. In some examples there may be a need to prevent movement of the diverter assembly if certain operations are being carried out, for example, alignment of components such as riser joints, or the like, which might otherwise be affected by orientation or inclination variations in the diverter assembly.

The movement control system may function to compensate for movement of the diverter assembly. For example, the movement control system may be responsive to movement of the diverter assembly and/or may respond to a change in position, orientation, inclination, or the like of the diverter assembly. Compensation of movement of the diverter assembly may prevent damage occurring to the diverter assembly, component, supporting structure, or any other component. For example, the movement control system may limit movement of the diverter assembly and/or may react to movement of or a force applied to the diverter assembly so as to inhibit, reduce, or mitigate the effects of the movement or force.

The movement control system may permit a degree of movement of the diverter assembly. The movement control system may permit a degree of movement of the diverter assembly within a predetermined range. The movement control system may function to ensure that the movement of the diverter assembly does not or is unlikely to exceed the predetermined range, which might otherwise cause damage. The movement control system may function to ensure that movement of the diverter assembly is controlled to reduce likelihood of sudden impacts or loading occurring, for example, by dampening movement of the diverter assembly.

The movement control system may reduce the risk of stress, fatigue, damage, mechanical failure, or the like being experienced by the diverter assembly and/or the component if the diverter assembly and/or the component moves or is subjected to a force. The movement control system may remove the need to include additional apparatus (e.g. in addition to the diverter assembly) for controlling movement of the component, which may reduce costs and/or may simplify servicing requirements. The reduction of risk of stress, fatigue, damage, mechanical failure, or the like may result in the diverter assembly and/or any component connected to the diverter assembly having a longer lifetime, require less frequent servicing, reduce the need to include additional features or additional apparatus for managing or reducing the effects of movement of any component, reduce costs, decrease rig time, and/or the like.

The movement control system may passively move or react to movement of or a force applied to the diverter assembly. The movement control system may actively move or control movement of the diverter assembly, which may be in response to movement of the component and/or if the diverter assembly needs to be moved or controlled in any appropriate way.

The drilling rig may define a well centre. The well centre assembly may be aligned with the well centre.

The movement control system may be mountable on the supporting structure of the offshore drilling rig.

The movement control system may be mounted on the supporting structure in any appropriate way. The movement control system may be mounted at least one of: above, below, to a side, and the like relative to the supporting structure.

The diverter assembly may be mountable on the movement control system.

The diverter assembly may be mounted on the movement control system in any appropriate way. The diverter assembly may be mounted at least one of: above, below, to a side, and the like relative to the movement control system. The diverter assembly may be positioned in any appropriate way relative to the movement control system. For example, at least a portion of the diverter assembly may be positioned relative to the movement control system by mounting on top of, mounting below, suspending from, or the like, relative to a component of the movement control system.

The supporting structure may be configured to provide support for the diverter assembly. The supporting structure may support the diverter assembly, for example, if the movement control system is not operational for any reason or if the movement control system has not been installed. The supporting structure may be configured to withstand the weight of a riser string before, during or after applying tension via a tension system for supporting the riser string. The tension may be applied to or via a spider for supporting the riser string. The tension system may comprise the spider.

The well centre assembly may be positioned in any appropriate way relative to a floor or deck of the offshore drilling rig. At least one of the movement control system and the diverter assembly may be provided or mounted below a drilling floor of the offshore drilling rig. For example, a floor, deck or other assembly may be provided below the drilling floor for providing the supporting structure.

The movement control system may comprise at least one actuator for controlling movement of the diverter assembly.

The actuator may be configured to control relative movement between the diverter assembly and the supporting structure. The actuator may be actuated in any appropriate way so as to control relative movement between the diverter assembly and the supporting structure.

The actuator may take any appropriate form. The actuator may be actuated in any appropriate way so that movement of the diverter assembly can be controlled in any appropriate way.

The actuator may be configured to permit, prevent, reduce, restrict, dampen, or otherwise control movement of the diverter assembly.

The actuator may be actuated so that the diverter assembly moves, is displaced, changes orientation, changes inclination, or the like. The actuator may be actuated so that the diverter assembly is prevented from moving or maintains a certain displacement, orientation, inclination, or the like.

The actuator may have a first configuration defining a first condition of the diverter assembly and a second configuration defining a second condition of the diverter assembly. The actuator may be actuatable so that the actuator can be switched, moved, cycled, or otherwise changed between the first and second configurations.

In the first condition, the diverter assembly may be moveable. When in the first condition, the diverter assembly may be moved as required or, depending on movement of a component mechanically associated with the diverter assembly, may be moved in a manner corresponding to movement of the component. If the actuator is in the first configuration, the actuator may move at least part of the diverter assembly or reduce movement, restrict movement, dampen movement, or otherwise control movement of at least part of the diverter assembly.

In the second condition, the diverter assembly may be fixed so as prevent movement of at least part of the diverter assembly. If the actuator is in the second configuration, the actuator may prevent movement of at least part of the diverter assembly.

In some examples there may be a plurality of actuators. One or more, or all, of the actuators may be provided in the first or second condition as required. The actuators may each be independently provided in one of the first and second configurations, which may cause different parts of the diverter assembly to be moveable, be moved, or fixed, depending on the configuration of each of the actuators.

At least one actuator may be configured to adjust the positioning, orientation, inclination, or the like of at least part of the diverter assembly. In some examples, at least one actuator may permit a change in the positioning, orientation, inclination, or the like, of the diverter assembly, for example, in response to movement of a component mechanically associated with the diverter assembly. In some examples, at least one actuator may be configured to prevent a change in the positioning, orientation, inclination, or the like of at least part of the diverter assembly.

The actuator may comprise a biasing element for reacting to a force applied to the diverter assembly. For example, the biasing element may comprise a spring and/or an element that provides a reaction force in response to a force applied to the element.

The actuator may comprise any appropriate system for controlling movement of the diverter assembly. For example, the actuator may comprise at least one of: a hydraulically-actuated system, a pneumatically-actuated system, an electrically-actuated system, a manually-actuated system, and/or the like, for controlling movement of the diverter assembly. The actuator may take any appropriate form for controlling movement of the diverter assembly.

The actuator may comprise a linear actuator. The linear actuator may be configured to provide movement in a straight line. The linear actuator may be at least one of: mechanically, hydraulically, pneumatically, electrically actuated, or otherwise actuated in any appropriate way.

The actuator may comprise a rotary actuator. The rotary actuator may be configured to provide rotary movement. The actuator may be configured to convert rotary movement of the rotary actuator into linear movement. For example, the actuator may comprise a rack and pinion arrangement or other appropriate arrangement for converting rotary movement of the rotary actuator into linear movement. The rotary actuator may be at least one of: mechanically, hydraulically, pneumatically, electrically actuated, or otherwise actuated in any appropriate way.

The actuator may comprise a movement system configured for controlling movement of the diverter assembly. The movement system may comprise a moveable element that can be moved in any appropriate way relative to another part of the actuator so as to control, move or to permit movement of the diverter assembly relative to the supporting structure. The moveable element may extend, retract, flex, compress, expand, fold, unfold, or otherwise move the moveable element of the movement system.

The hydraulically-actuated system may comprise a hydraulic fluid supply and a hydraulic controller configured to control movement of the diverter assembly by utilising hydraulic fluid to actuate the actuator. For example, the hydraulically-actuated system may be operated to move the diverter assembly and/or to control movement of the diverter assembly. The hydraulically-actuated system may comprise or define the movement system. The hydraulically-actuated system may comprise a hydraulic cylinder. The hydraulic cylinder may comprise or define a cylinder system. The hydraulic cylinder may comprise a cylinder and a piston, the piston being operable to move, e.g. back and forth or the like, in the cylinder in response to a force exerted on the piston by hydraulic fluid pressure, or the like.

The pneumatically-actuated system may comprise a gas supply and a pneumatic assembly configured to control movement of the diverter assembly by utilising gas pressure. For example, the pneumatic-actuated system may be operated to move the diverter assembly and/or to control movement of the diverter assembly. The pneumatically-actuated system may comprise or define the movement system.

The electrically-actuated system may comprise an electric motor configured to control movement of the diverter assembly. For example, the electric motor may be operated to move the diverter assembly and/or to control movement of the diverter assembly.

The electrically-actuated system may comprise or define the movement system. The electric motor may be configured to provide rotary movement. The electric motor may be configured to provide linear movement. The electrically-actuated system may be configured to convert rotary movement, e.g. of a rotatable component of the electric motor, into linear movement, e.g. via a linear actuator coupled to the rotatable component of the electric motor. Any appropriate type of electric motor may be used, for example, a DC or AC electric motor, a rotary induction motor, a linear induction motor, a stepper motor, or the like.

The electrically-actuated system may comprise a linear actuator. The electrically-actuated system may comprise a solenoid actuator. The electrically-actuated system may comprise an electromagnetically-controlled actuator, for example, an actuator configured to control movement of a moveable component of the actuator by utilising an electrical current to drive an electromagnet operable to control movement of the moveable component of the actuator. The electromagnetically-controlled actuator may comprise a permanent magnet element. The moveable component of the actuator may be configured to move linearly, rotatably, or in any other appropriate way. The electrically-actuated system may comprise a piezoelectric actuator.

The manually-actuated system may comprise a user-operated system configured to control movement of the diverter assembly. For example, the user-operated system may be manually operated so as to move the diverter assembly and/or to control movement of the diverter assembly. The manually-actuated system may comprise or define the movement system. The manually-actuated system may comprise a rotary actuator. The rotary actuator of the manually-actuated system may be configured to provide rotary movement. The manually-actuated system may be configured to convert rotary movement of the rotary actuator into linear movement, for example, via a rack and pinion arrangement, gear arrangement, or the like.

The actuator may comprise a controller configured to provide control of the actuator. The movement control system may comprise a controller configured to control the actuator.

The actuator may comprise a fluid-powered actuator. The fluid-powered actuator may comprise a fluid-actuated component configured to move in response to a force applied by the fluid on the fluid-actuated component. The fluid-powered actuator may comprise a ram cylinder. The fluid-powered actuator may comprise a telescopic ram cylinder. The fluid-powered actuator may comprise a cylinder system. The fluid-powered actuator may comprise a piston-and-rod cylinder arrangement. The fluid-powered actuator may comprise bellows. The bellows may be deformable by pressurised fluid, for example, by hydraulic fluid or gas.

Any combination of actuators may be utilised for controlling movement of the diverter assembly.

The actuator may comprise a cylinder system configured to control movement of the diverter assembly. The cylinder system may comprise a cylinder arrangement that can be extended or retracted so as to move or to permit movement of the diverter assembly. The cylinder system may be actuatable in any appropriate way. For example, the cylinder system may comprise a moveable element for extending or retracting relative to the cylinder system. The cylinder system may comprise a piston and cylinder arrangement. The cylinder system may comprise a telescopic cylinder arrangement.

The cylinder system may comprise a pressurised fluid supply for extending or retracting a piston of the cylinder system relative to a cylinder of the cylinder system. The cylinder system may comprise or define the movement system.

The cylinder system may comprise a compensating cylinder system configured to compensate for movement of the diverter assembly relative to the supporting structure.

The actuator may be connected to the supporting structure and/or the diverter assembly in any appropriate manner. For example, the actuator may comprise at least one pivoted, rotatable or otherwise moveable connection for providing at least one axis of rotation between the actuator, the diverter assembly and/or the support structure. The diverter assembly may have more than one degree of freedom of movement relative to the supporting structure. Providing a moveable connection between the actuator, the diverter assembly and/or the support structure may permit at least one part of the diverter assembly to move in any appropriate way relative to the supporting structure. For example, at least part of the diverter assembly may be capable of at least one of: displacing, shifting, rotating, swivelling, tilting and pivoting, and the like, relative to the supporting structure.

The movement control system may provide a gimbal system for permitting the supporting structure to remain in a static position, for example in a same plane, while the diverter assembly is permitted to move relative to the supporting structure.

The actuator may be configurable between an extended configuration and a retracted configuration, for example, so as to control movement of the diverter assembly relative to the supporting structure.

The actuator may be provided in the extended or retracted configuration by actuating the movement system. Changing the configuration of the actuator between the extended and retracted configurations may vary a spacing between the diverter assembly and the supporting structure, for example, a part of the diverter assembly may be moved by the actuator relative to the supporting structure so as to vary the spacing between the part of the diverter assembly and the supporting structure. By varying the spacing between the diverter assembly and the supporting structure, the diverter assembly may be moved in any appropriate way so as to control, accommodate or permit movement of any component mechanically associated the diverter assembly. For example, if the component adopts or moves to a certain position, orientation or inclination, the actuator may control movement of the diverter assembly in any appropriate manner so that the diverter assembly accommodates the movement, positioning, orientation, or inclination of the component so as to reduce loading, stress, or the like on the diverter assembly and/or the component. In some examples, the actuator may control movement of the diverter assembly without accommodating the movement, positioning, orientation, or inclination of the component, which may be required in some situations, such as when certain operations need to be carried out.

The actuator may be fixable to define a fixed spacing between at least part of the diverter assembly and the supporting structure.

If the actuator is fixed, at least part of the diverter assembly may not be permitted to move relative to the supporting structure. Fixing the actuator such that at least part of the diverter assembly maintains a fixed position may be useful in situations where the diverter assembly is required in a certain position, orientation, inclination, or the like to permit certain operations to be carried out. The actuator may be lockable to control movement of the diverter assembly such that the diverter assembly is not permitted to move.

The well centre assembly may comprise a plurality of actuators.

The actuators may be provided, for example located, at different positions between the diverter assembly and the supporting structure. The location of the actuators may define or provide for at least one degree of freedom of movement of the diverter assembly relative to the supporting structure. The actuators may be provided at any appropriate location between the diverter assembly and the supporting structure. For example, the actuators may be provided circumferentially spaced apart, or may be provided in any appropriate arrangement.

The well centre assembly may comprise at least one support member for supporting the diverter assembly. For example the support member may support the diverter assembly in the event of failure of the movement control system and/or if a component of the movement control system needs to be inspected, repaired or replaced. The support member may comprise or define a shoulder configured to support the diverter assembly.

The actuators may be independently actuatable and/or may be collectively actuated. Independently actuating the actuators may cause at least part of the diverter assembly to move, for example, tilt, pivot, or the like. Independently actuating the actuators may control movement of the diverter assembly so that at least part of the diverter assembly may move whereas another part of the diverter assembly may be prevented from moving. Independently actuating the actuators may control movement of the diverter assembly so that at least part of the diverter assembly may move in a first direction or at a first rate of movement whereas another part may move in a second direction or at a second rate of movement. For example, one part of the diverter assembly may move in a different manner to another part of the diverter assembly. Independently actuating the actuators may control movement of the diverter assembly so that the diverter assembly may tilt, rotate, pivot, or otherwise move to vary the positioning, orientation, inclination, or the like of the diverter assembly. Collectively actuating the actuators, for example actuating the actuators at the same rate, may cause the diverter assembly to move, for example, move vertically or in any other appropriate manner.

The movement control system may be configured to compensate for movement of the diverter assembly out of a plane defined by the supporting structure.

The supporting structure may define a horizontal plane of the offshore drilling rig. The horizontal plane of the offshore drilling rig may be defined by a deck or a floor of the offshore drilling rig, for example, the horizontal plane may be parallel to the drilling floor. If the movement control system is in a first condition, for example an uncompensated condition, the diverter assembly may be oriented or inclined such that a plane defined by the diverter assembly is parallel to the horizontal plane. In the first condition, the diverter assembly may define a longitudinal axis perpendicular to the horizontal plane, for example, the diverter assembly may be considered to be oriented or inclined in a vertical or upright position.

If the movement control system is in a second condition, for example a compensated condition, the diverter assembly may be oriented or inclined such that the plane defined by the diverter assembly is at an angle to the horizontal plane. In the second condition, the longitudinal axis of the diverter assembly may be perpendicular to the plane defined by the diverter assembly, for example, the diverter assembly may be considered to be oriented or inclined at an angle to the vertical or upright position. In some examples, the compensated condition may be considered to be when the diverter assembly is oriented or inclined such that the plane defined by the diverter assembly is parallel or substantially parallel to the horizontal plane.

The movement control system may be configured to compensate for an angular variation in an orientation or inclination of the diverter assembly relative to the supporting structure.

In use, there may be an angular variation in the orientation or inclination of the diverter assembly, for example, in response to movement of a component connected to the diverter assembly. The movement control system may control the angular variation so as to reduce or mitigate loading or stress applied to the diverter assembly and/or any component connected to the diverter assembly.

The supporting structure may define a vertical orientation, for example, between the well centre assembly and a moonpool area of the offshore drilling rig. The diverter assembly may be oriented or inclined in the vertical orientation, for example, if a component connected to the diverter assembly is also vertically oriented or inclined. The angular variation in the orientation or inclination of the diverter assembly may be less than or equal to 5 degrees from the vertical orientation or inclination. The angular variation in the orientation or inclination of the diverter assembly may be more than 5 degrees from the vertical orientation. The angular variation may be determined by the particular operating parameters of the diverter assembly and/or any component connected to the diverter assembly. For example, certain components may be configured or permitted to move within a certain range of angular variation, which may be appropriate if there is a higher risk of damage occurring to the diverter assembly and/or the component beyond the certain range of angular variation.

The movement control system may be configured to control movement of the diverter assembly so that a vertical variation in a spacing between the diverter assembly and the supporting structure is permitted or controlled.

In use, there may be vertical variation in the spacing between the diverter assembly and the supporting structure, for example, in response to movement of a component connected to the diverter assembly. For example, the buoyancy and/or tension of the component may change so that the component has a tendency to move vertically. The movement control system may control the vertical variation so as to reduce loading or stress applied to the diverter assembly and/or any component connected to the diverter assembly.

The diverter assembly may define a throughbore configured to permit passage of a riser joint therethrough during deployment or retrieval thereof.

In use, the diverter assembly may permit deployment or retrieval of a riser comprising a plurality of riser joints through the throughbore of the diverter assembly. The riser joint or any other component connected to or associated with the diverter assembly may move the diverter assembly relative to the supporting structure. For example, a force applied to the riser may bend, distort or otherwise move the riser such that the diverter assembly moves, if permitted to do so, relative to the supporting structure. The movement control system may control such movement and/or may protect the riser from loading, stress or other potential damaging effects caused by an external force applied to the riser.

The riser may comprise an element such as a buoyancy element, or the like, which may be relatively easily damaged if there is an impact between the riser and another structure, for example, another structure of the offshore drilling rig. Therefore, the movement control system may function to prevent or reduce the effects of such an impact so as to reduce the likelihood of damage occurring in the event of a force, for example a transverse force, being applied to the riser. The movement control system may alternatively or additionally protect components of the diverter assembly from damage, for example by reducing loading, stress or other potential damaging effects caused by an external force applied to the riser.

The potential damaging effects may be particularly relevant during deployment or retrieval of the riser, or during a hang-off scenario which may occur if the riser is disconnected from the wellhead. The riser may have a free end (e.g. a lower end of the riser) that is more susceptible to external forces such as currents, wind, waves, or the like than when the riser is connected to a wellhead at the seabed. However, the riser may still be at risk of potential damage even if the riser is connected to the wellhead.

The throughbore of the diverter assembly may be configured to permit passage of any appropriate tool during deployment or retrieval thereof. For example, the throughbore may permit the passage of drilling tools and/or other downhole tools therethrough. The riser may be connectible to or in communication with the diverter assembly so as to permit the passage of the drilling and other downhole tools through the throughbore of the diverter assembly and the riser.

The diverter assembly may be connectible to at least one diverter connector for receiving fluid diverted by the diverter assembly. The diverter connector may be configured to permit movement of the diverter assembly while maintaining fluid communication with the diverter assembly.

In use, the diverter assembly may be used to divert fluid away from a work area of the offshore drilling rig, for example, during a gas kick from a formation such as a shallow formation or indeed any other part of a formation. The diverter connector may permit a fluid connection between the diverter assembly and the diverter connector to be maintained while permitting movement of the diverter assembly relative to the support structure.

The diverter assembly may comprise at least one diverter connector. The diverter connector may comprise any appropriate component for permitting relative movement between the diverter assembly and a diverter conduit for diverting fluid away from the diverter assembly. The diverter connector may comprise at least one of: a flexible, conformable, deformable, extendible, compressible, or otherwise reconfigurable component for permitting said relative movement between the diverter assembly and the diverter conduit.

The diverter assembly may comprise at least one of: a rotary table and a spider.

The diverter assembly may comprise any appropriate component associated with drilling and/or other downhole operations, for example, in addition to at least one of the rotary table and the spider. Any of the rotary table and the spider may be removed and/or replaced as required, at least one of the rotary table and the spider being fixable to the diverter assembly. The diverter assembly comprising the additional components may be moveable relative to the support structure so that, upon a component connected to the diverter assembly moving, the assembly comprising the diverter assembly and the additional components, may be moveable in unison by virtue of the movement control system permitting or controlling said movement. The spider may support a riser string if at any time the weight of the riser string is not supported by the supporting structure and/or the diverter assembly. The supporting structure may be able to withstand the weight of the riser string before, during or after tension is applied to the riser string via the spider.

In operation, movement of the diverter assembly may be controlled, for example compensated, while deploying, running or retrieving a riser or during a storm hang-off event in which the riser is disconnected from the wellhead.

The actuators, for example compensating cylinders or the like, may be adjusted to align the diverter assembly horizontally in order to compensate for a prevailing riser angle (e.g. inclination, orientation, or the like) such as caused by e.g. current drag, wave movement and/or wind movement.

The actuators, for example, compensating cylinders may be locked in an operational mode so that the diverter arrangement can be fixed.

Active adjustment of inclination of the diverter assembly may facilitate riser deployment, running and/or retrieval in high currents, which may reduce the risk of clashing between the outer diameter of the riser and the inner diameter of a housing of the diverter assembly and/or a tensioning element such as a tensioning ring, and/or may reduce the risk of damage caused by buoyancy of the riser. The diverter assembly may include at least one of the spider and the rotary table so as to define a single assembly that can be actively adjusted as required.

Active adjustment of inclination for the diverter assembly and/or rotary table and/or the spider may facilitate riser deployment, running, and/or retrieval under increased pitch and/or roll motion such as may occur in higher sea states (e.g. if there is a higher activity of wave, wind and/or tidal motion, or the like). In higher sea states there may be a reduced clash risk if there is active adjustment of inclination for the housing of the diverter and/or rotary table and/or the spider.

Active adjustment of inclination for the diverter assembly and/or rotary table and the spider in a hang-off scenario (e.g. a hard hang-off scenario in which the riser is disconnected from the wellhead) may reduce the risk of clashing between the riser and a moonpool structure of the offshore drilling rig.

The well centre assembly may provide a permanent storage location for a gimbal system built into a substructure of the drilling floor, and may have access for maintenance of the gimbal system. The gimbal system may comprise or define the movement system. The gimbal system may comprise gimbal pistons, cylinders, or the like and a hydraulic system for actuating the gimbal pistons, cylinders, or the like.

The gimbal system may comprise a gimbal control system. The gimbal control system may facilitate operation, for example control, of fixed pistons, cylinders, or the like. The gimbal control system may facilitate providing, for example control, passively compensated pistons, cylinders, or the like. The gimbal control system may facilitate actuation, for example control, of actively compensated pistons, cylinders, or the like. The gimbal control system may enable deflection of the diverter assembly and/or rotary table and/or spider. The deflection may be a change in inclination, for example, above, equal to, or below 5 degrees, or any other appropriate inclination of the diverter assembly.

During riser deployment, running or retrieval operations the allowable inclination of the riser may be driven by any requirements there may be for vertical alignment of mating riser joints or connectors prior to stabbing.

Depending on the effectiveness and reliability of the gimbal system, the arrangement may hold a potential for designing out the need for an upper flex joint used for connected case drilling and non-drilling operations, which may compensate for up to and equal to 4 degrees or above 4 degrees angular misalignment.

The well centre assembly may provide redundancy, for example partial, complete or 100% redundancy, in the event of loss of one or more of the actuators. If one or more of the actuators breaks down or cannot be used for any reason, the well centre assembly may still function to control movement of the diverter assembly since the movement control system may not require all actuators to be used to still retain functionality e.g. to maintain normal operation of the movement control system.

In case of losing one actuator e.g. due to failure thereof, it may be possible to elevate the diverter assembly without affecting functionality of the movement control system. For example, the movement control system may function to control movement of the diverter assembly even with the loss of the actuator, or in some examples, more than one of the actuators. In some examples, the actuators may comprise a compensating cylinder system. The compensating cylinder system may comprise extendable/retractable cylinders configured to control movement of the diverter assembly. In use, the cylinders may be stroked out, whereupon a support element (e.g. a safety spacer, or the like) may be inserted to support the diverter assembly and then a failed/broken-down cylinder can be replaced or repaired.

In case of being close to losing all of the actuators e.g. due to failure thereof, for example cylinders, the remaining cylinders can be stroked in and the diverter assembly may be able to rest on support members, for example structural hard shoulders or the like. In this configuration, the diverter assembly may not permit movement of the diverter assembly, for example, the diverter assembly may be considered to be in a non-compensating configuration.

In case of complete failure of the actuators, for example cylinders, the cylinders may be configured to automatically vent so that diverter assembly may rest on the support members.

The cylinders may be connected to at least one of a hydraulic control system, a hydraulic fluid supply and a controller. The cylinders may be actuated by hydraulic fluid controlled by the hydraulic control system using fluid from the hydraulic fluid supply. The controller may operate the cylinders independently or collectively in any appropriate way so that the cylinders may at least one of: extend, retract, prevent movement, permit movement, or otherwise control movement thereof, so as to control movement of the diverter assembly.

Rigid or flexible connections may be provided so as to connect to the rotary table and/or the spider and/or the controller. The connections may be made up in situ once the diverter assembly, movement control system, rotary table, spider, controller and any other components are in situ e.g. provided in the supporting structure.

Access to the diverter assembly and/or movement control system may be provided in any appropriate way. For example, at least one access, opening, door, hatch or the like may permit access, for example user access, to the diverter assembly and/or movement control system. Access may be provided to an interior of a housing for accommodating the diverter assembly and/or movement control system. The access, opening, door, hatch or the like may be disposed in the housing, for example in a wall of the housing. At least one access, opening, door, hatch, or the like may provide access to the diverter assembly and/or movement control system. A user may access the diverter assembly and/or movement control system to inspect, maintain, replace or otherwise access the diverter assembly and/or movement control system for any reason.

The diverter assembly and/or rotary table and/or spider, and/or any other components may be installed or retrieved via the drilling floor for maintenance, or the like, e.g. by use of the drilling hoisting equipment such as a main hook, or the like.

During operation, a gap between the rotary table and the drilling floor structure may be covered by removable hatches, or the like, so as to provide access to a subfloor of the offshore drilling rig, or the supporting structure of the offshore drilling rig.

A diverter conduit such as a rigid connector (e.g. a rigid pipe, or the like) may be connected to a diverter outlet via a diverter connector, which may be in the form of a flexible connector, or the like to permit a degree of movement between the diverter assembly and the supporting structure.

An aspect or embodiment of the present disclosure relates to an offshore drilling rig, comprising: a supporting structure; a diverter assembly; and a movement control system operable between the diverter assembly and the supporting structure. The movement control system may be configured to control movement of the diverter assembly.

The offshore drilling rig may comprise a component for connecting the diverter assembly to a wellhead.

The component may form part of a string, for example, a riser string or the like. The string may extend at least partially between the offshore drilling rig and the wellhead. The component may comprise any appropriate connector, for example, a riser joint or the like for connecting the diverter assembly to another part of a riser string.

The offshore drilling rig may comprise a tensioner system for controlling a tension applied to the component.

The tensioner system may comprise at least one retaining element for supporting or holding the component relative to the supporting structure. The retaining element may comprise a tensioning ring. The tensioner system may comprise at least one tensioner connected to the retaining element. The tensioner may control the retaining element in any appropriate way. The tensioner may be configured to controllably support, hold or move the retaining element relative to the supporting structure so as to control, maintain or vary a tension of or applied to the component. The tensioner may take any appropriate form.

The tensioner may comprise a winch, capstan, windlass, pulley system, or the like, for controlling or varying a force applied to the retaining element. The tensioner system may comprise a drive for controlling or varying a force applied to the retaining element, for example, by controlling or varying a force applied to the retaining element via the winch, capstan, windlass, or the like. The drive may be actuated in any appropriate way, for example, by an electric, hydraulic or pneumatic motor, or the like. The tensioner system may comprise a retaining element support for supporting the retaining element relative to the supporting structure and/or the tensioner. The retaining element support may comprise a tensioning ring support for supporting the tensioning ring. The retaining element support may comprise a support cable, rope, rod, or any other appropriate member. The tensioner may control or vary tension in the retaining element support, and/or apply a force to the retaining element support, so as to control or vary the force applied to the component by the retaining element.

The tensioner may comprise a cylinder system, for example a hydraulic or pneumatic cylinder system, or the like. The cylinder system may comprise a cylinder and a piston, the piston being operable to move, e.g. back and forth or the like, in the cylinder in response to a force exerted on the piston by fluid pressure, or the like. The cylinder system may be configured to control movement of or apply a force to the retaining element so as to control or vary a force applied to the component. The cylinder system may be operable to apply a force on the retaining element via the retaining element support. The retaining element support may comprise a rigid member, rod, or the like, for connecting the retaining element and the cylinder system.

The tensioner system may assist in controlling movement of the component, for example, as result of changes in buoyancy of the component or a connector in the form of a riser in response to tidal, current, wind, and/or wave movement, or the like. The tensioning system may protect the diverter assembly and/or movement control system from damage caused by movement, e.g. vertical movement, lateral movement, or the like, of the component relative to the offshore drilling rig.

The diverter assembly may comprise at least one of: a rotary table and a spider.

The offshore drilling rig may comprise any feature of the well centre assembly according to any aspect or embodiment of the present disclosure. The offshore drilling rig may comprise at least one of: a supporting structure; a diverter assembly; and a movement control system according to any aspect or embodiment of the present disclosure.

The offshore drilling rig may comprise any other appropriate component utilised for drilling or other offshore operations.

An aspect or embodiment of the present disclosure relates to a method of controlling a diverter assembly for an offshore drilling rig, comprising: permitting movement of a diverter assembly relative to a supporting structure of an offshore drilling rig; and controlling movement of the diverter assembly relative to the supporting structure.

The method may comprise controlling movement of the diverter assembly by limiting, preventing, restricting or stopping movement of the diverter assembly relative to the supporting structure.

The method may comprise controlling movement of the diverter assembly by permitting, allowing, varying the rate of, or dampening movement of the diverter assembly relative to the supporting structure.

Controlling the spacing may comprise maintaining a fixed spacing or varying the spacing between the diverter assembly and the supporting structure. Fixing the spacing may permit inspection, maintenance or replacement to be carried out on any component.

Fixing the spacing may maintain the diverter assembly in a fixed relationship relative to the supporting structure to enable operations requiring a certain orientation of the diverter assembly to be carried out. For example, the diverter assembly may comprise a throughbore for permitting the passage of a riser joint therethrough. As the riser is made up or taken apart, riser joints may be connected together or disconnected, which may require the diverter assembly to maintain a certain orientation or inclination, for example a vertical orientation or inclination defined by the throughbore of the diverter assembly.

Varying the spacing may permit the diverter assembly to vary in terms of position, orientation or inclination relative to the supporting structure. Actively controlling movement of the diverter assembly may compensate for movement of the diverter assembly by actively applying a force to the diverter assembly to permit, reduce, restrict, prevent, dampen, or otherwise control movement of the diverter assembly. Passively controlling movement of the diverter assembly may compensate for movement of the diverter assembly by passively responding to a force applied by the diverter assembly so as to permit, reduce, restrict, prevent, dampen, or otherwise control movement of the diverter assembly.

The method may comprise controlling a position, orientation or inclination of the diverter assembly relative to the supporting structure.

The method may comprise permitting a position, orientation, inclination or the like, of the diverter assembly to change, for example, by allowing movement or actively providing movement of the diverter assembly. The method may comprise preventing the position, orientation, inclination or the like, of the diverter assembly from changing, for example, by preventing, restricting or stopping movement of the diverter assembly. The method may comprise permitting the position, orientation, inclination or the like, of part of the diverter assembly to change and preventing the position, orientation, inclination or the like, of another part of the diverter assembly from changing.

The method may comprise compensating for movement of a component mechanically associated with the diverter assembly.

The component may be mechanically associated with the diverter assembly by being connected to the diverter assembly, or rigidly connected to the diverter assembly so that movement of the component causes corresponding movement of the diverter assembly if this is permitted, or a build-up of loading, stress, or the like in the component and/or diverter assembly if movement of the diverter assembly is not permitted. The component may comprise a riser joint or other component associated with the diverter assembly. Movement of the component may cause the diverter assembly to move. Compensating for movement of the diverter assembly may permit the component to move while reducing the likelihood of loading, stress, or other type of mechanical failure causing damage to the diverter system and/or the component.

The method may comprise compensating for movement of the component during deployment or retrieval of the component between the offshore drilling rig and a wellhead, and/or during a hang-off scenario in which the component is disconnected from the wellhead.

The component may comprise any appropriate connector. The connector may form part of a string. The string may comprise a riser string. The connector may comprise a riser joint for forming part of the riser string.

The method may comprise disconnecting the riser from the wellhead, for example in a hang off scenario. By compensating for movement of the riser via the diverter assembly, the method may help to prevent clashing between the riser and another structure, for example, in or around a moonpool of the offshore drilling rig. During rough weather conditions and/or where there are strong currents, movement of wind and/or water or the like, the riser may move, which may cause a change in the position or angle of the riser relative to the offshore drilling rig. Accordingly, compensating for movement of the riser may help to reduce the effects of wind and/or water movement on the riser and the offshore drilling rig so as to reduce the likelihood of damage occurring.

The method may comprise compensating for movement of the component when, during deployment, retrieval or a hang-off scenario, the component provides at least part of a connection between the offshore drilling rig and the wellhead.

The method may comprise determining a movement parameter of the diverter assembly and controlling movement of the diverter assembly based on the movement parameter.

The movement parameter may comprise or define at least one of: a linear displacement, a vertical displacement, a horizontal displacement, an angular displacement, a tilting displacement, a pivoting displacement, an orientation, and/or any other appropriate measurement defining a position, orientation, inclination, or the like of the diverter assembly relative to the supporting structure. The movement parameter may comprise a change in at least one of: a position, orientation, and inclination of the diverter assembly. The movement parameter may comprise at least one of: a direction, speed, velocity, and the like. The movement parameter may comprise at least one of: acceleration, acceleration magnitude, acceleration direction, force, pressure, tension, stress, and the like.

The method may comprise determining, for example actively determining, how to control movement of the diverter system so as to reduce the likelihood of damage occurring to any component of the diverter assembly and/or any component connected to the diverter assembly.

Determining the movement parameter may comprise taking a measurement, utilising data from a sensor associated with at least one of the supporting structure, the diverter assembly, a component connected to or otherwise mechanically associated with the diverter assembly such as a string or riser string, the offshore drilling rig, and the like. The sensor may take a measurement and the method may comprise analysing the measurement and/or any other data to determine the movement parameter. The method may comprise making a decision regarding how to control movement of the diverter assembly and/or any component connected to or mechanically associated with the diverter assembly.

The method may comprise determining a further movement parameter upon compensating for movement of the diverter assembly so as to define a feedback loop for compensating for movement of the diverter assembly relative to the supporting structure.

The method may comprise utilising a movement control system operable between the diverter assembly and a supporting structure of an offshore drilling rig to control movement of the diverter assembly relative to the supporting structure of the offshore drilling rig.

The method may comprise actuating the movement control system to permit at least one actuator of the movement control system to be inspected, repaired or replaced.

The method may comprise supporting the diverter assembly on at least one support member in case of failure of the movement control system. The method may comprise controlling at least one actuator to move the diverter assembly to predetermined condition, for example, a maintenance condition. In the maintenance condition, maintenance may be carried out on any component. The maintenance condition may define a position, orientation, inclination, or the like of the diverter assembly.

The method may comprise moving the diverter assembly and inserting a support element between the diverter assembly and the supporting structure. The method may comprise moving the diverter assembly to be supported by the support element. The method may comprise inspecting, repairing, replacing or otherwise maintaining a component, for example an actuator or the like, of the movement control system. The support element may be removed as required, for example, when the diverter assembly is supported by the support element.

The method may comprise moving the diverter system and/or any associated components via a drilling floor of the offshore drilling rig, for example by lifting, lowering, installing or retrieving the diverter assembly and/or any other associated component e.g. using drilling hoisting equipment.

The method may comprise configuring the diverter assembly to adopt a fixed position, orientation or inclination relative to the supporting structure.

Fixing the position, orientation or inclination of the diverter assembly may permit a connector such as a riser joint to be connected to another connector so that a relative position, orientation or inclination of the connectors is within an acceptable tolerance range to permit a good quality connection to be made up between the connectors. For example, while the connectors are being connected or disconnected it may be necessary to ensure that the connectors are appropriately aligned so that when the connectors are connected or disconnected, a good quality connection can be made up between the connectors, e.g. to avoid a poor connection being made up and/or to avoid angular misalignment between the connectors. In some examples the connectors may comprise a screw thread arrangement for allowing the connector to be joined to a complementary screw thread arrangement of another connector. If the connectors are not correctly aligned, e.g. within the acceptable tolerance range, then the connectors may not be easily screwed together or screwed apart. If the diverter assembly is in a position, orientation or inclination that causes the connector to be angularly misaligned, then it may be difficult or impossible to connect another connector to the angularly misaligned connector.

If the diverter assembly is positioned, oriented or inclined outside the acceptable tolerance range of relative positions, orientations or inclinations, fixing the position, orientation or inclination of the diverter assembly within the tolerance range may assist in the making up of a good quality connection. Fixing the position, orientation or inclination of the diverter assembly may be required in some examples in order to permit certain operations to be carried out, such as riser joint connecting or disconnecting operations during deployment or retrieval of the riser, or the like. Once the operation has been carried out it may be appropriate to permit the diverter assembly to be moveable relative to the supporting structure and/or to control relative movement therebetween.

It should be understood that any one or more of the features of any one or more of the disclosed examples, aspects and/or embodiments may apply alone or in any combination in relation to any one or more of the other examples, aspects and/or embodiments disclosed herein.

BRIEF DESCRIPTION OF THE DRAWINGS

These and other examples of the present disclosure will now be explained, by way of example only, with reference to the following drawings, in which.

DETAILED DESCRIPTION OF THE DRAWINGS

Figure 1:
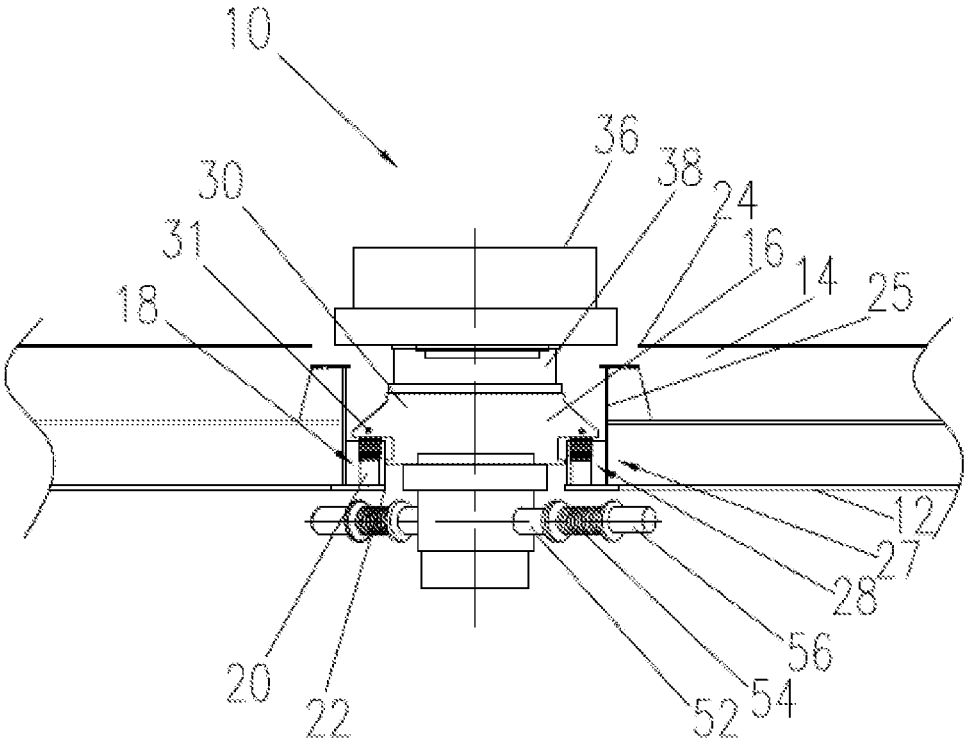
FIG. 1 is a schematic side view of a well centre assembly according to an example of the present disclosure.
Figure 2:
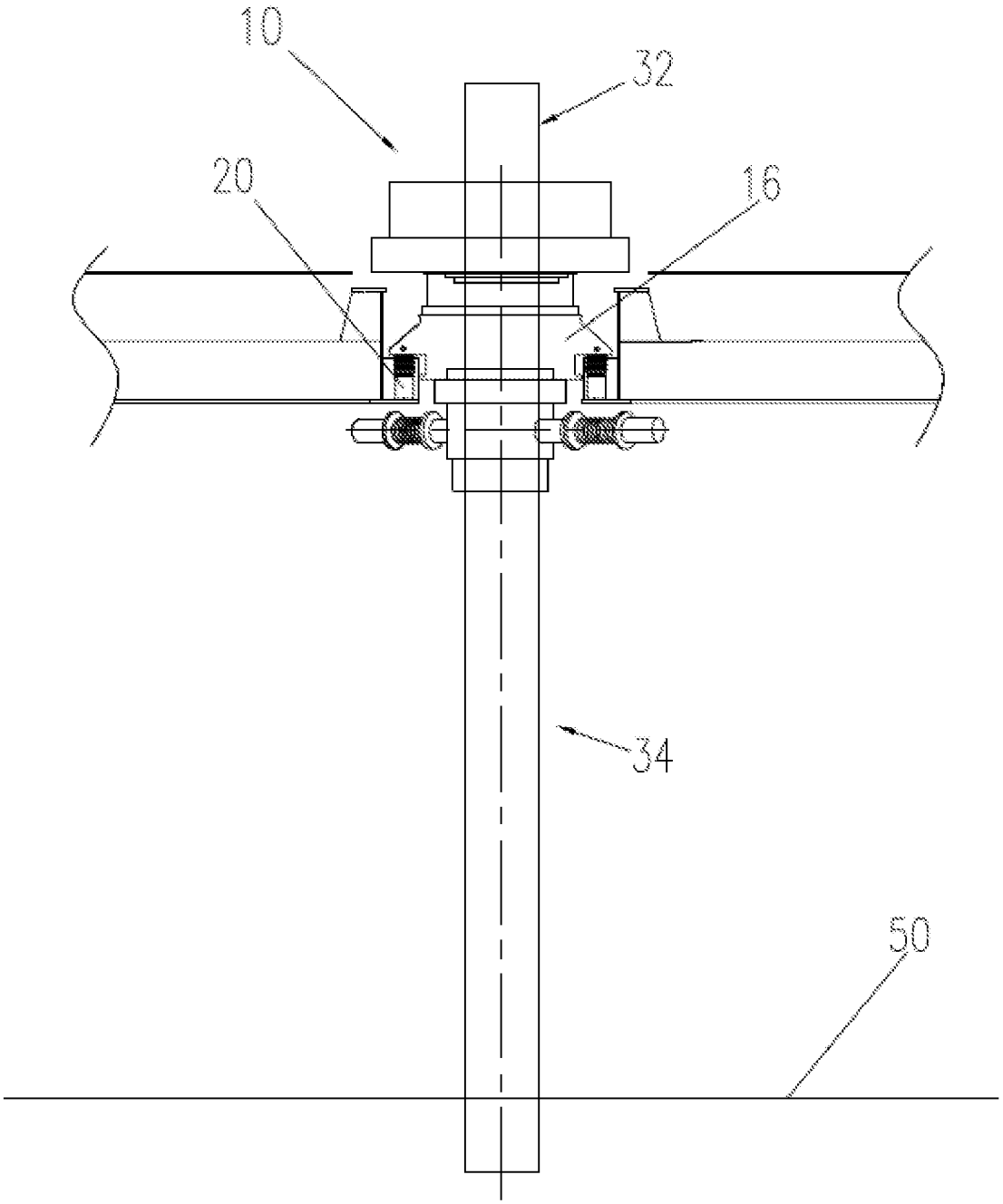
FIG. 2 is a schematic side view of the well centre assembly, the assembly supporting a riser in a vertical inclination.
Figure 3:
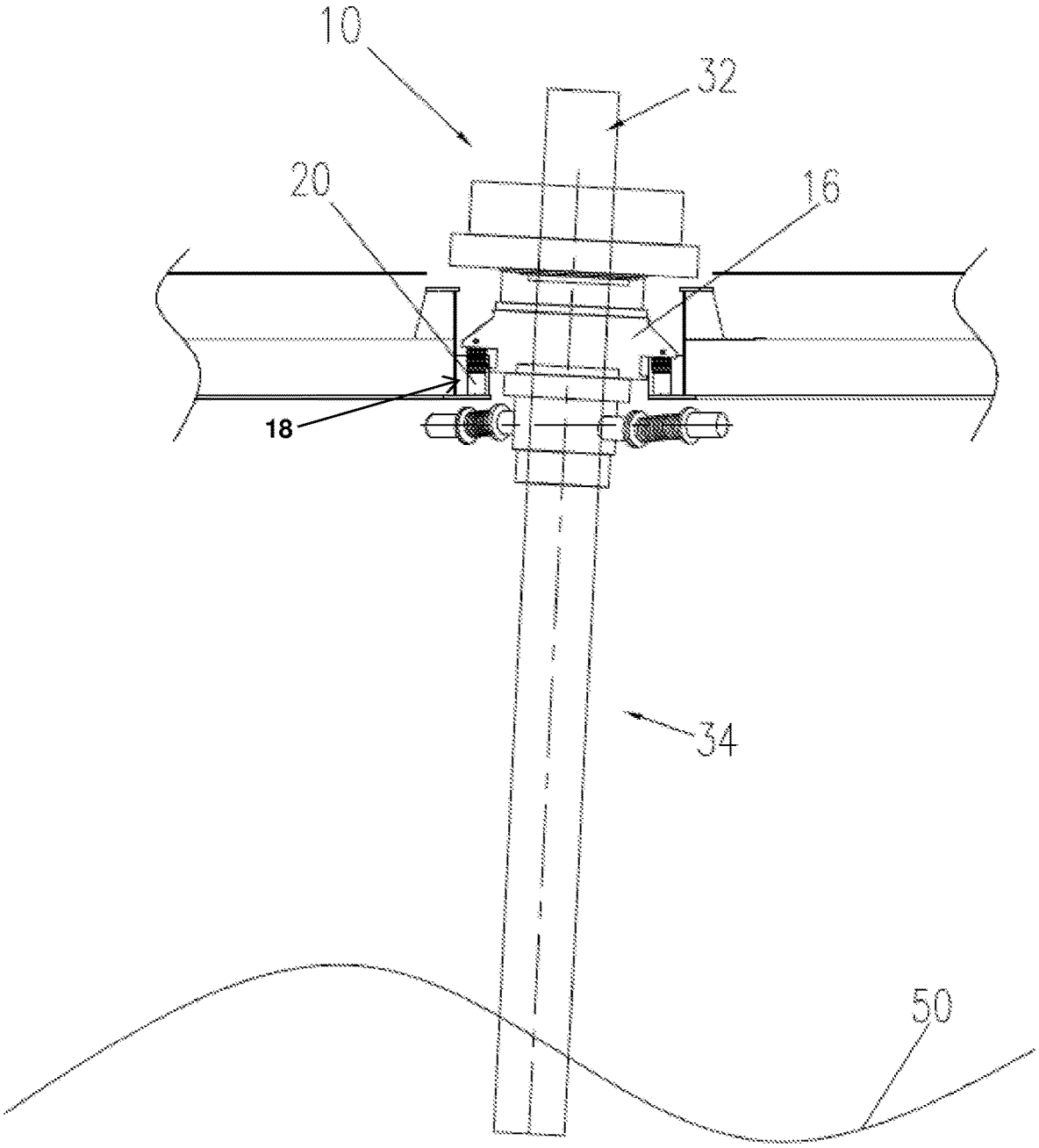
FIG. 3 is a further schematic side view of the well centre assembly, the assembly supporting the riser, which in this example is inclined relative to the vertical inclination of the riser illustrated by FIG. 2.

FIGS. 1, 2 and 3 illustrate a well centre assembly 10 according to an example of the present disclosure. The well centre assembly 10 may be concerned with various operations associated with offshore hydrocarbon extraction, for example, drilling operations and the like. The well centre assembly 10 is supported by a supporting structure 12 of an offshore drilling rig (not shown), which in this example is disposed below a drilling floor 14 of the offshore drilling rig.

The well centre assembly 10 includes a diverter assembly 16 mounted on a movement control system 18, which in this example includes a plurality of actuators 20 for controlling movement of the diverter assembly 16 relative to the supporting structure 12. The actuators 20 are supported by the supporting structure 12. An opening 22 in the supporting structure 12 is aligned with a drilling floor opening 24 in the drilling floor 14. The drilling floor opening 24 may be sized or configurable in size to permit the diverter assembly 16 to be provided on, inserted into or removed from supporting structure 12 via the drilling floor opening 24. For example, during installation of the diverter assembly 16 and/or at least part of the movement control system 18, the diverter assembly 16 and/or the movement control system 18 can be installed by being passed through the drilling floor opening 24 and appropriately aligned relative to the opening 22 in the supporting structure 12. The diverter assembly 16 extends partially through the opening 22 once installed. Similarly, when being removed, the diverter assembly 16 and/or at least part of the movement control system 18 can be retrieved via the drilling floor opening 24.

Figure 4A:
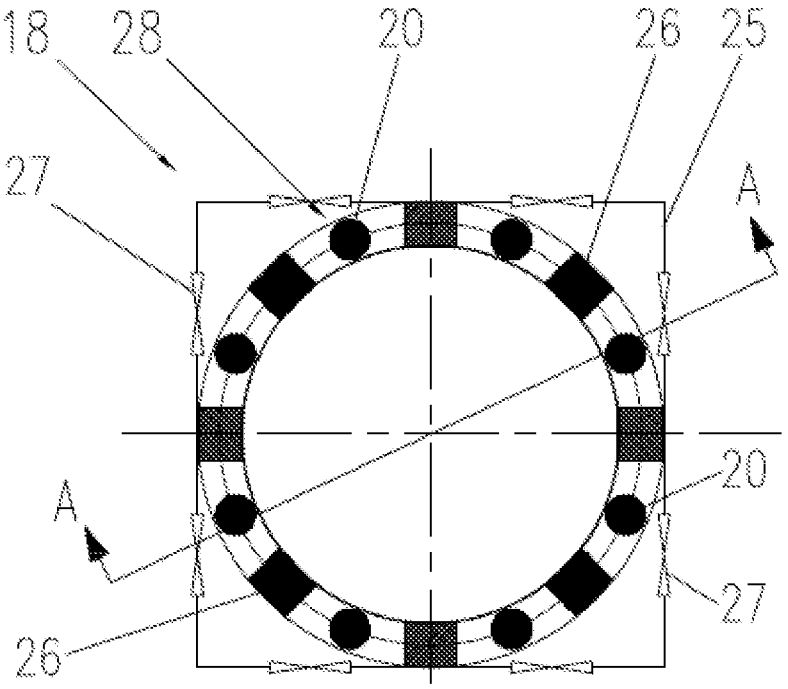
FIG. 4*a* is a cross-sectional view of a movement control system of the well centre assembly of FIGS. 1 to 3.
Figure 4B:
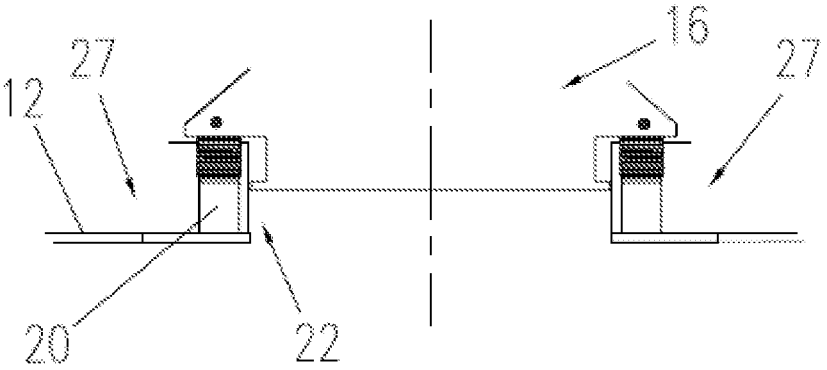
FIG. 4*b* is a cross-sectional view of the movement control system across the section A-A in FIG. 4*a;*

As best illustrated by FIG. 4*a*, the actuators 20 are disposed circumferentially spaced apart around the opening 22 of the supporting structure 12. The supporting structure 12 also includes a plurality of support members 26 for supporting the diverter assembly 16. The support members 26 are disposed circumferentially spaced apart around the opening 22 and are interposed between adjacent circumferentially spaced-apart actuators 20. The support members 26 provide a back-up support for the diverter assembly 16 in the event of failure of at least one of the actuators 20, if maintenance needs to be carried out, and/or if the actuators 20 are not required for any reason. At least part of the movement control system 18 and/or the diverter assembly is provided within a housing 25. If maintenance is required, at least one access hatch 27 of the housing 25 provides access to at least part of the movement control system 18 and/or the diverter assembly. It will be appreciated that access to the movement control system 18 and/or diverter assembly 16 may be provided in any other appropriate way. FIG. 4*b* illustrates section A-A of FIG. 4*a* and includes part of the diverter assembly 16 including an access hatch 27 either side of the housing 25.

The actuators 20 are actuatable so as to control movement of the diverter assembly 16 relative to the supporting structure 12. The actuators 20 include or define a movement system configured for controlling movement of the diverter assembly 16. In this example, the actuators 20 each include a cylinder arrangement 28 forming a compensating cylinder system that is actuatable by pressurised fluid. In use, the compensating cylinder system uses pressurised fluid to extend and/or retract at least part of the cylinder arrangement 28 so as to control movement of the actuator 20, as is described in greater detail herein. The actuator 20 may actively apply a force or respond passively (e.g. by applying a reaction force in response) to an applied force exerted on the actuator 20 by the diverter assembly 16. Each of the actuators 20 may move, permit, prevent, restrict, reduce, dampen or otherwise control movement of the diverter assembly 16 in any appropriate way.

The diverter assembly 16 includes at least one shoulder 30 for mounting the diverter assembly 16 on the actuators 20. Extending at least one of the actuators 20 causes at least part of the diverter assembly 16 to be moved away from the supporting structure 12 so as to increase a vertical spacing between the supporting structure 12 and the shoulder 30. Retracting at least one of actuators 20 causes at least part of the diverter assembly 16 to be moved towards the supporting structure 12 so as to decrease the vertical spacing between the supporting structure 12 and the shoulder 30. Each of the actuators 20 can be independently actuated or the actuators 20 can be actuated in unison, or in any appropriate sequence. Extending and/or retracting the actuators 20 can move the diverter assembly 16 or permit the diverter assembly 16 to move so as to vary at least one of: a position, orientation and inclination of the diverter assembly 16. For example, at least one of the actuators 20 can be actuated to move or to permit movement of the diverter assembly 16 vertically and/or to orient or incline (e.g. tilt, rotate, pivot, angle, or otherwise move) the diverter assembly 16 in any appropriate way. The shoulder 30 includes a moveable connection in the form of a pivot pin 31 connecting the diverter assembly 16 to the actuator 20, the pivot pin 31 being arranged to permit the diverter assembly 16 to move, for example tilt, pivot or the like in response to extension or retraction of the actuators 20.

If the diverter assembly 16 moves, providing the movement control system 18 may permit such movement, and at least one of the actuators 20 may control movement of the diverter assembly 16 in any appropriate way. Such a situation may occur if a component, which in this example is in the form of a riser joint 32 of a riser string 34, is connected to or otherwise has a fixed inclination relative to the diverter assembly 16. FIGS. 2 and 3 illustrate the example of the riser joint 32 passing through or being held within (depending on the stage of the riser deployment/retrieval process) a spider 36, a rotary table 38 and the diverter assembly 16. Each of the spider 36, rotary table 38 and the diverter assembly 16 includes a throughbore or passageway for permitting the passage of a component e.g. the riser joint 32 therethrough. The supporting structure 12 is configured to withstand the weight of the riser string 34 before, during or after applying tension via the spider 36 for supporting the riser string 34. The supporting structure 12 is configured to withstand the weight of the riser string 34 if the spider 36 does not support the riser string 34.

FIG. 2 illustrates an example where the riser 34 is vertically inclined (i.e. the riser 34 is not inclined at an angle to the vertical) relative to the supporting structure 12 and extending below a water surface 50. FIG. 3 illustrates an example where the riser 34 is inclined at an angle relative to the vertical inclination of the riser string 34 illustrated by FIG. 2. Depending on wind, water current, wave and/or tidal conditions or the like, the riser string 34 inclination may vary as illustrated by FIGS. 2 and 3. For example, FIG. 2 shows the water surface 50 as being relatively even with the riser 34 in the vertical inclination. Providing forces on the riser 34 such as caused by water current, wind, waves, and the like do not cause the riser 34 to move from the vertical inclination, the riser 34 may remain substantially in the vertical inclination of FIG. 2. FIG. 3 shows the water surface 50 as being uneven (for example due to wave motion), but it is possible that water current, wind, and the like are also present. In the example of FIG. 3, the riser 34 is inclined at an angle to the vertical due to the movement of the water (e.g. due to water current and/or wave movement) and/or due to wind movement. In some examples, either or both of the riser 34 and the supporting structure 12 may move, for example if the offshore drilling rig is of a floating type, in response to water and/or wind movement. Relative movement between the riser 34 and the supporting structure 12 may be controlled in any appropriate way. It will be appreciated that the riser 34 may be longer than or shorter than the riser 34 illustrated in FIGS. 2-3.

In some examples there may be prevailing current which may cause the riser 34 to adopt a relatively fixed orientation relative to the supporting structure 12. In some examples, such as in poor weather conditions (e.g. in a storm, high winds, or the like), the riser 34 may swing or move continuously or continually so that the inclination of the riser 34 relative to the supporting structure 12 varies. In any of the examples, the diverter assembly 16 may move or be permitted to move by the movement control system 18.

In some examples, a relatively fixed orientation of the diverter assembly 16 relative to the supporting structure 12 may be required, for example if a riser joint 32 connection is being made up above the drilling floor 14. In this situation, the actuators 20 may be configured to prevent movement of the diverter assembly 16 and to force the diverter assembly 16 to adopt a certain orientation, for example, a vertical inclination such as that illustrated by FIG. 2. If the riser joint 32 is not correctly oriented or inclined it may be difficult to make up a connection between two riser joints 32. The same may apply for connecting together any type of connector.

The diverter assembly 16 further includes at least one diverter outlet 52, in this example there are two diverter outlets 52 illustrated, for connecting to corresponding diverter connectors 54. The diverter assembly 16 may function to divert fluid away from a work area of the offshore drilling rig, for example, during a gas kick from a formation. The diverter connectors 54 provide fluid communication between the diverter outlets 52 and a diverter conduit 56 for diverting fluid away from the diverter assembly 16 while permitting movement of the diverter assembly 16 relative to the supporting structure 12. The diverter connectors 54 may include a flexible, conformable, deformable, extendible, compressible, or otherwise adaptable component for permitting said relative movement between the diverter assembly 16 and the diverter conduit 56. Providing the diverter connectors 54 may allow the diverter assembly 16 to move as required and may avoid compromising on the safety function of the diverter assembly 16.

Figure 5:
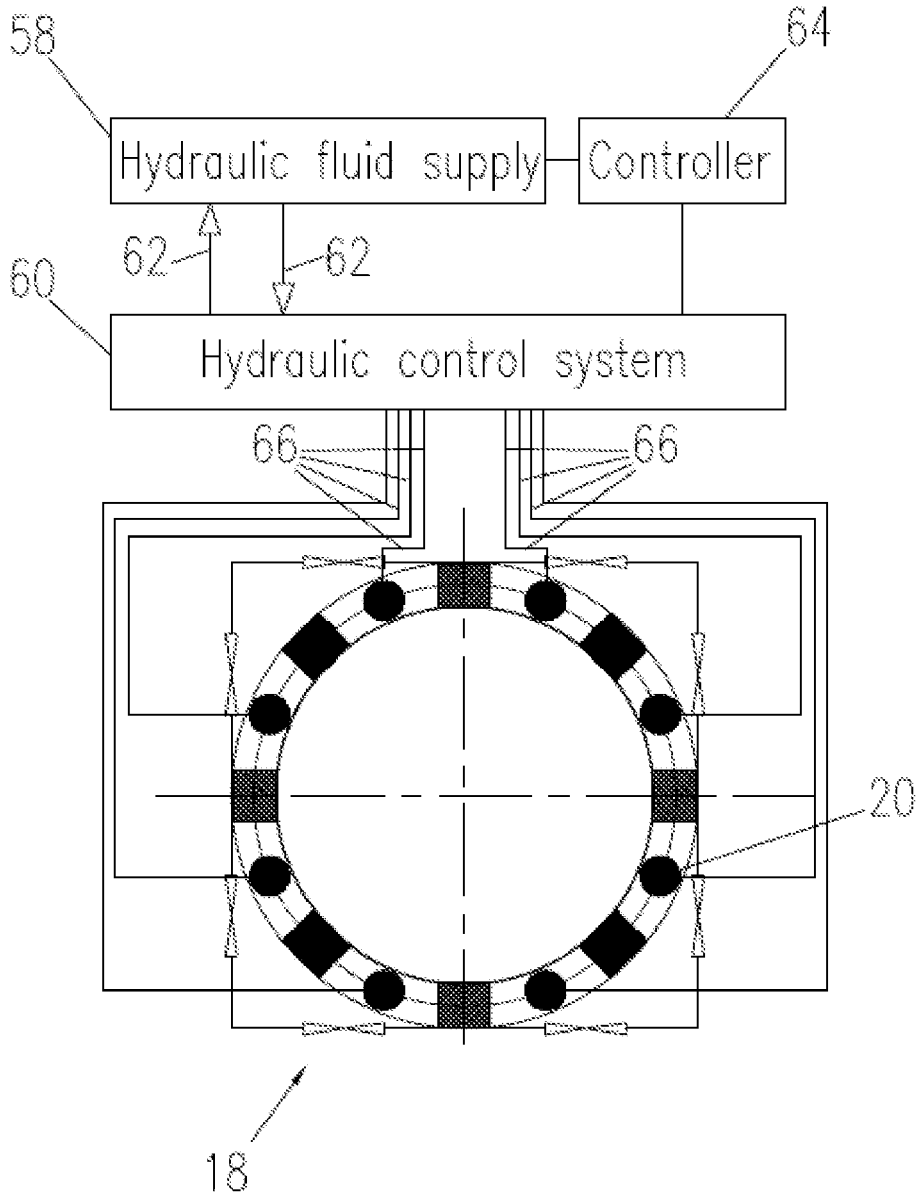
FIG. 5 is a cross-sectional view of the movement control system of FIG. 4*a* and including further components for operating the movement control system.

FIGS. 4*a*, 4*b* and 5 illustrate at least part of the movement control system 18 and diverter assembly 16. FIG. 5 illustrates an example of the movement control system 18. The movement control system includes a hydraulic fluid supply 58 configured to supply fluid to or from a hydraulic control system 60 via supply fluid connectors 62 (which may be in the form of rigid or flexible hoses, or the like). The hydraulic fluid supply 58 and hydraulic control system 60 are connected to a controller 64 which functions to control operation of the hydraulic fluid supply 58 and hydraulic control system 60. The controller 64 can be manually or automatically operated. The controller 64 may be configured to receive data from one or more sensors (not shown, but for example could be provided on any component) configured to collect data such as movement data from the diverter assembly 16 and/or movement control system 18. The hydraulic control system 60 is provided in fluid communication with each of the actuators 20 via actuator fluid connectors 66 (which may be in the form of rigid or flexible hoses, or the like). The supply fluid connectors 62 and/or the actuator fluid connectors 66 can include one or more fluid conduits for passing hydraulic fluid therethrough for actuating one or more of the actuators 20. The hydraulic fluid supply 58, the hydraulic control system 60, the supply fluid connectors 62, the actuator fluid connectors 66 and any other components may comprise any appropriate valve arrangement and/or pump arrangement so as to provide fluid pressure for actuating the actuators 20 as required. Since each actuator 20 can be individually addressed, each actuator 20 can individually, or where appropriate, collectively, control movement of the diverter assembly 16 by either moving, permitting movement, restricting, reducing, dampening, or otherwise controlling movement of the diverter assembly 16.

Figure 6:
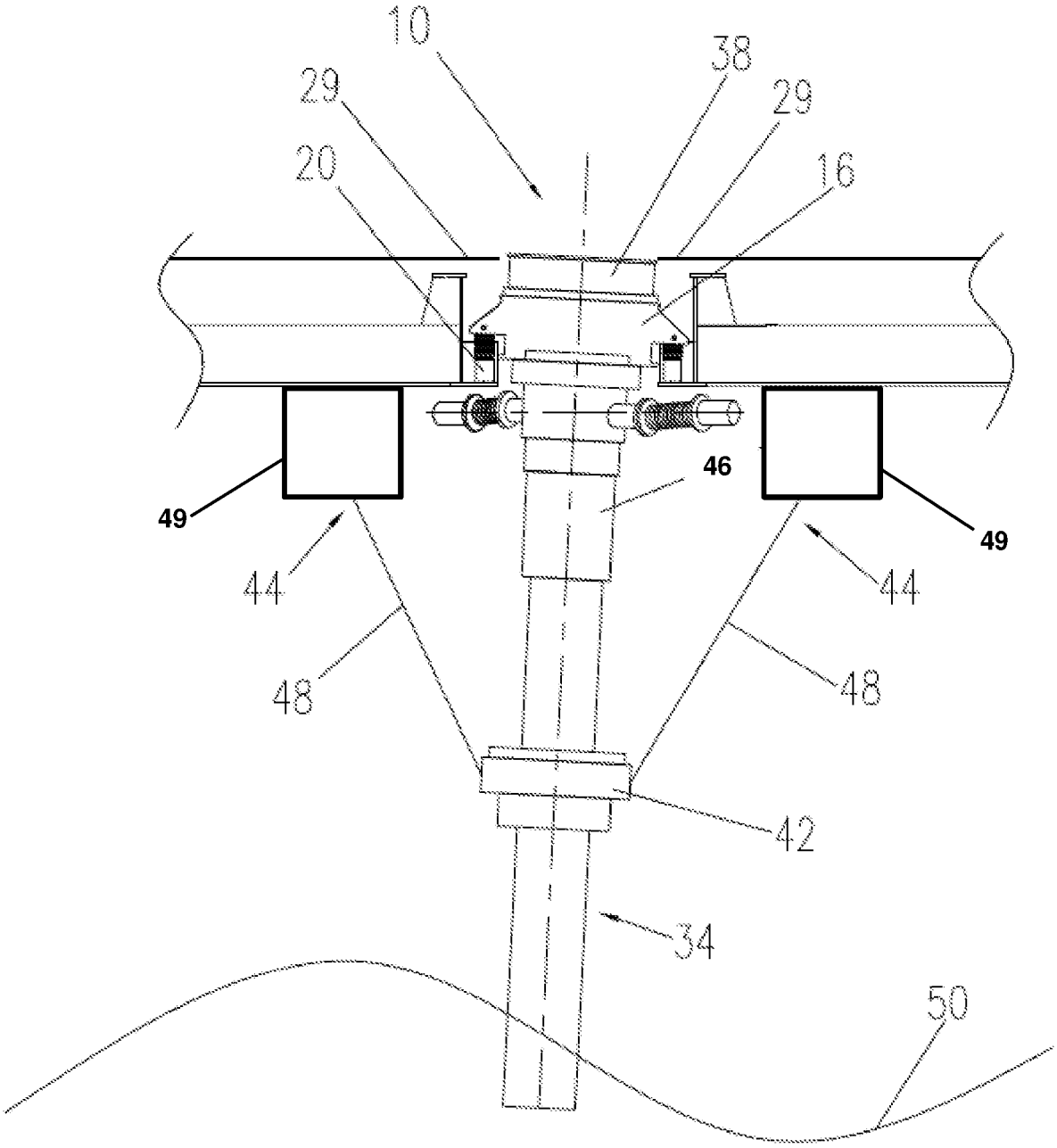
FIG. 6 is a schematic side view of the well centre assembly, with a deployed riser.

Reference is now also made to FIG. 6 of the drawings, which illustrates the well centre assembly 10 in combination with an installed riser string 34. The spider 36 used during the deployment of the riser 34 has been removed and a cover 29 has been fitted to the drilling floor 14 to cover the gap between the drilling floor opening 24 and the assembly 10. The riser string 34 includes an upper flex joint 46 and a tensioning ring 42. The tensioning ring 42 is supported from the supporting structure 12 using a tensioner system 44. The tensioner system 44 supports the tensioning ring 42 via a number of support cables 48 so as to control the tension in the riser string 34.

The tensioner system 44 is configured to control or vary tension in the support cables 48, which in turn permits the tensioner system 44 to control the tension in the riser string 34. In this example the tensioner system 44 is in the form of a winch 49 supported by the supporting structure 12 and operable to control or vary tension in the support cables 48. The tension in the riser string 34 may depend on a number of factors, including movement of the riser string 34, buoyancy of the riser string 34, current, tidal movement, or the like. The tensioner system 44 can react to changes in the tension of the riser string 34 and/or control tension of the riser string 34 by applying a force via the cable 48 to either pull the riser string 34 upwards or permit movement of the riser string 34 downwards, so as to vary or control the tension in the riser string 34.

As noted above, the well centre assembly 10 of the disclosure has particular utility when deploying or retrieving a riser string 34. However, the assembly 10 may also be operated in combination with a deployed riser string 34, which may incorporate one or more flex joints 46, as illustrated in FIG. 6. Alternatively, the assembly 10 may be locked in position when the riser string 34 is fully deployed.

It will be appreciated that various modifications or alternative features may be provided where appropriate. Any of the features that are described as being an example may be readily replaced by any other appropriate feature providing the same, similar, equivalent or different function. Various options are described in the summary section of the present disclosure. Further examples of modifications or alternatives are described below.

It will be appreciated that the diverter assembly 16 could include any appropriate component. The diverter assembly 16 may be configured to compensate for movement of the riser 34 or other connector, but may not necessarily include all of the components illustrated by the illustrated example. For example, the diverter assembly 16 may only include the diverter assembly 16, wherein the diverter assembly 16 is the only component of the well centre assembly 10 that is configured for compensating for movement of the riser 34 or other connector. The diverter assembly 16 may include at least one component, including at least one of: a spider 36, a rotary table 38, and the diverter assembly 16, wherein the movement control system 18 compensates for movement of the riser 34 as described herein.

The invention claimed is:

1. A well centre assembly for an offshore drilling rig, comprising:

a movement control system, a supporting structure of the offshore drilling rig, and a diverter assembly, wherein the diverter assembly is connectible to at least one diverter connector for receiving fluid diverted by the diverter assembly, wherein the diverter connector is configured to permit movement of the diverter assembly while maintaining fluid communication with the diverter assembly, a riser connected to the diverter assembly, wherein the movement control system is operable between the diverter assembly and the supporting structure of the offshore drilling rig, and wherein the movement control system is configured to control movement of the diverter assembly to compensate for movement of the riser.

2. The well centre assembly according to claim 1, wherein the movement control system comprises at least one actuator for controlling movement of the diverter assembly, and wherein the actuator is configurable between an extended configuration and a retracted configuration to control movement of the diverter assembly relative to the supporting structure.

3. The well centre assembly according to claim 2, wherein the movement control system comprises a plurality of actuators, and each of the plurality of actuators is fixable to define a fixed spacing between at least part of the diverter assembly and the supporting structure.

4. The well centre assembly according to claim 1, wherein the movement control system is configured to compensate for movement of the diverter assembly out of a plane defined by the supporting structure.

5. The well centre assembly according to claim 1, wherein the movement control system is configured to compensate for an angular variation in an orientation or inclination of the diverter assembly relative to the supporting structure.

6. The well centre assembly according to claim 1, wherein the diverter assembly defines a throughbore configured to permit passage of a riser joint of the riser therethrough during deployment or retrieval thereof.

7. The well centre assembly according to claim 1, wherein the diverter assembly comprises at least one of a rotary table and a spider.

8. An offshore drilling rig, comprising:

a movement control system;

a supporting structure; and a diverter assembly, wherein the diverter assembly is connectible to at least one diverter connector for receiving fluid diverted by the diverter assembly, wherein the diverter connector is configured to permit movement of the diverter assembly while maintaining fluid communication with the diverter assembly;

a riser connected to the diverter assembly;

wherein the movement control system being operable between the diverter assembly and the supporting structure of the offshore drilling rig;

and the movement control system configured to control movement of the diverter assembly to compensate for movement of the riser.

9. The offshore drilling rig according to claim 8, further comprising a tensioner system for controlling a tension applied to the riser.

10. The offshore drilling rig according to claim 8, wherein the diverter assembly comprises at least one of a rotary table and a spider.

11. A method of controlling a diverter assembly for an offshore drilling rig comprising a riser connected to the diverter assembly, wherein the diverter assembly is connectible to at least one diverter connector for receiving fluid diverted by the diverter assembly, wherein the diverter connector is configured to permit movement of the diverter assembly while maintaining fluid communication with the diverter assembly, the method comprises steps of:

controlling movement of the diverter assembly relative to a supporting structure of the offshore drilling rig by operating a movement control system between the diverter assembly and the supporting structure to compensate for movement of the riser.

12. The method according to claim 11, wherein the controlling of movement of the diverter assembly includes at least one of:

limiting, preventing, restricting or stopping movement of the diverter assembly relative to the supporting structure.

13. The method according to claim 11, wherein the controlling of movement of the diverter assembly includes at least one of:

permitting, allowing, varying the rate of, or dampening movement of the diverter assembly relative to the supporting structure.

14. The method according to claim 11, wherein the controlling of movement of the diverter assembly includes at least one of:

controlling a position, orientation or inclination of the diverter assembly relative to the supporting structure.

15. The method according to claim 11 and comprising compensating for movement of the riser during deployment or retrieval of the riser between the offshore drilling rig and a wellhead, and/or during a hang-off scenario in which the riser is disconnected from the wellhead.

16. The method according to claim 11 and comprising determining a movement parameter of the diverter assembly and controlling movement of the diverter assembly based on the movement parameter.

17. The method according to claim 11 and comprising determining a further movement parameter upon compensating for movement of the diverter assembly to define a feedback loop for compensating for movement of the diverter assembly relative to the supporting structure.

18. The method according to claim 11 and comprising utilizing the movement control system operable between the diverter assembly and the supporting structure of the offshore drilling rig to control movement of the diverter assembly relative to the supporting structure of the offshore drilling rig, and further comprising actuating the movement control system to permit at least one actuator of the movement control system to be inspected, repaired or replaced.

* * * * *